United States Patent [19]

Terauchi

[11] Patent Number: 4,913,627

[45] Date of Patent: Apr. 3, 1990

[54] WOBBLE PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 223,338

[22] Filed: Jul. 25, 1988

[30] Foreign Application Priority Data

Jul. 23, 1987 [JP] Japan ..... 62-182293

[51] Int. Cl.[4] ..... F04B 1/26

[52] U.S. Cl. ..... 417/222

[58] Field of Search ..... 417/222 S, 270

[56] References Cited

U.S. PATENT DOCUMENTS

| | | | |
|---|---|---|---|
| 4,428,718 | 1/1984 | Skinner . | |
| 4,685,866 | 8/1987 | Takenaka et al. . | |
| 4,702,677 | 10/1987 | Takenaka et al. . | |
| 4,723,891 | 2/1988 | Takenaka | 417/270 |
| 4,730,986 | 3/1988 | Kayukawa et al. . | |
| 4,732,544 | 3/1988 | Kurosawa | 417/270 |
| 4,747,753 | 5/1988 | Taguchi . | |
| 4,842,488 | 6/1989 | Terauchi . | |

FOREIGN PATENT DOCUMENTS

| | | |
|---|---|---|
| 61-55380 | 3/1986 | Japan . |

*Primary Examiner*—Leonard E. Smith
*Attorney, Agent, or Firm*—Banner, Birch, McKie & Beckett

[57] ABSTRACT

A refrigerant compressor including a compressor housing having a cylinder block is disclosed. A plurality of cylinders are formed around the periphery of the cylinder block and a piston slidably fitted within each of the cylinders. The pistons are reciprocated by a drive mechanism. A crank chamber is formed between the cylinder block and a front end plate of the compressor housing. A drive mechanism includes a drive shaft, a rotor disposed on said drive shaft, a slant plate with an adjustable slant angle disposed adjacent the rotor, and a wobble plate disposed adjacent the slant plate. Rotation of the drive shaft causes rotation of the rotor and the slant plate, resulting in nutational motion of the wobble plate to reciprocate the pistons within their cylinders. The slant angle of the slant plate changes in response to a change of pressure in the crank chamber to change the capacity of the compressor. The compressor housing includes a rear end plate with suction and discharge chambers. A passageway links the suction chamber and the crank chamber and is controlled by a control mechanism. The control mechanism includes a first control valve element which controls the opening and closing of one end of the passageway responsive to the pressure in the suction chamber and a second valve control element which controls the opening and closing of the other end of the passageway in response to a pressure difference between the suction and discharge chambers. The second valve control element opens the passageway, linking the first control valve element to the suction chamber when the difference in pressure between the discharge chamber and the suction chamber becomes greater than a predetermined value. In a second embodiment, the first valve control element is responsive to a change in pressure in the crank chamber.

10 Claims, 2 Drawing Sheets

WOBBLE PLATE TYPE COMPRESSOR WITH VARIABLE DISPLACEMENT MECHANISM

BACKGROUND OF THE INVENTION

1. Field Of The Invention

The present invention relates to a refrigerant compressor, and more particularly, to a wobble plate type compressor with a variable displacement mechanism suitable for use in an automotive air conditioning system.

2. Description Of The Prior Art

The use of a wobble plate type compressor with a variable displacement mechanism in an automotive air conditioning system is well known. The compressor includes a drive shaft with an inclined plate attached thereto, and a wobble plate located adjacent the inclined plate. The wobble plate is attached by connecting rods to pistons located in respective cylinders. Rotating motion of the drive shaft and inclined plate is converted into nutating motion of the wobble plate, reciprocating the pistons in the cylinders. The variable displacement mechanism controls the pressure in the crank chamber in accordance with external operating conditions to vary the inclination angle of the inclined plate. Accordingly, the stroke length of the pistons is varied in accordance with the change in angle of the inclined plate to change the compression ratio of the compressor.

If the compressor described above is used in an automotive air conditioning system, it is not necessary to control the air temperature by clutch cycling. Therefore, torque shock caused by clutch cycling is prevented. However, at the time when the main switch of the air conditioning system is turned on, it is initially necessary to turn the clutch on and off, thereby producing torque shock.

In light of the above problem, a coil spring is used to reduce the angle of the inclined plate with respect to the drive shaft when the main switch is off in order to reduce torque shock. However, when the clutch is turned on by the main switch, the suction pressure in the compressor becomes very large, and in the prior art, the pressure difference between the crank chamber and the suction chamber is almost equalized, thereby lowering the crank chamber pressure. Accordingly, a moment acs on the inclined plate so that its angle with respect to a plane perpendicular to the longitudinal axis of the drive shaft is at its greatest, producing a high compression capacity. This large compressor capacity occurs for an instant when the air conditioning system is turned on, producing an extremely large torque shock.

SUMMARY OF THE INVENTION

It is an object of this invention to provide a wobble plate type compressor with a variable displacement mechanism for reducing torque shock.

A refrigerant compressor according to the present invention includes a compressor housing comprising a cylinder block with a front end plate and a rear end plate attached thereto. A crank chamber is defined between the front end plate and the cylinder block and a plurality of cylinders are formed in the cylinder block. A piston is slidably fitted within each of the cylinders and the pistons are reciprocated by a drive mechanism including a wobble plate, an adjustable slant plate with an inclined surface, a rotor and a drive shaft. The rotor is fixed to the drive shaft and the adjustable slant plate is connected to the rotor at an adjustable slant angle with respect to a plane perpendicular to the longitudinal axis of the drive shaft. The slant angle of the slant plate and the wobble plate connected in close proximity thereto, changes in accordance with the change of pressure in the crank chamber to change the capacity of the compressor. The drive shaft extends through the wobble plate and is rotatably supported by bearings within the front end plate and in a central bore in the cylinder block. Rotation of the rotor by the drive shaft causes the slant plate to rotate as well, nutating the wobble plate and reciprocating the pistons in the cylinders.

The rear end plate is disposed on the opposite end of the cylinder block from the front end plate and includes a suction chamber and a discharge chamber therein. A control mechanism controls the opening and closing of a passageway linking the suction chamber with the crank chamber. The control mechanism includes a first control valve controlling the opening and closing of one end of the passageway in response to the pressure in either the suction chamber or the crank chamber and a second control valve controlling the opening and closing of the other end of the passageway in response to a pressure difference between the suction chamber and the discharge chamber. The second control valve acts when the pressure difference becomes greater than or equal to a predetermined value.

Further objects, features and other aspects of the invention will be understood from the detailed description of the preferred embodiments of the invention with reference to the drawings.

DETAILED DESCRIPTION OF THE PREFERRED EMBODIMENTS

Figure 1:
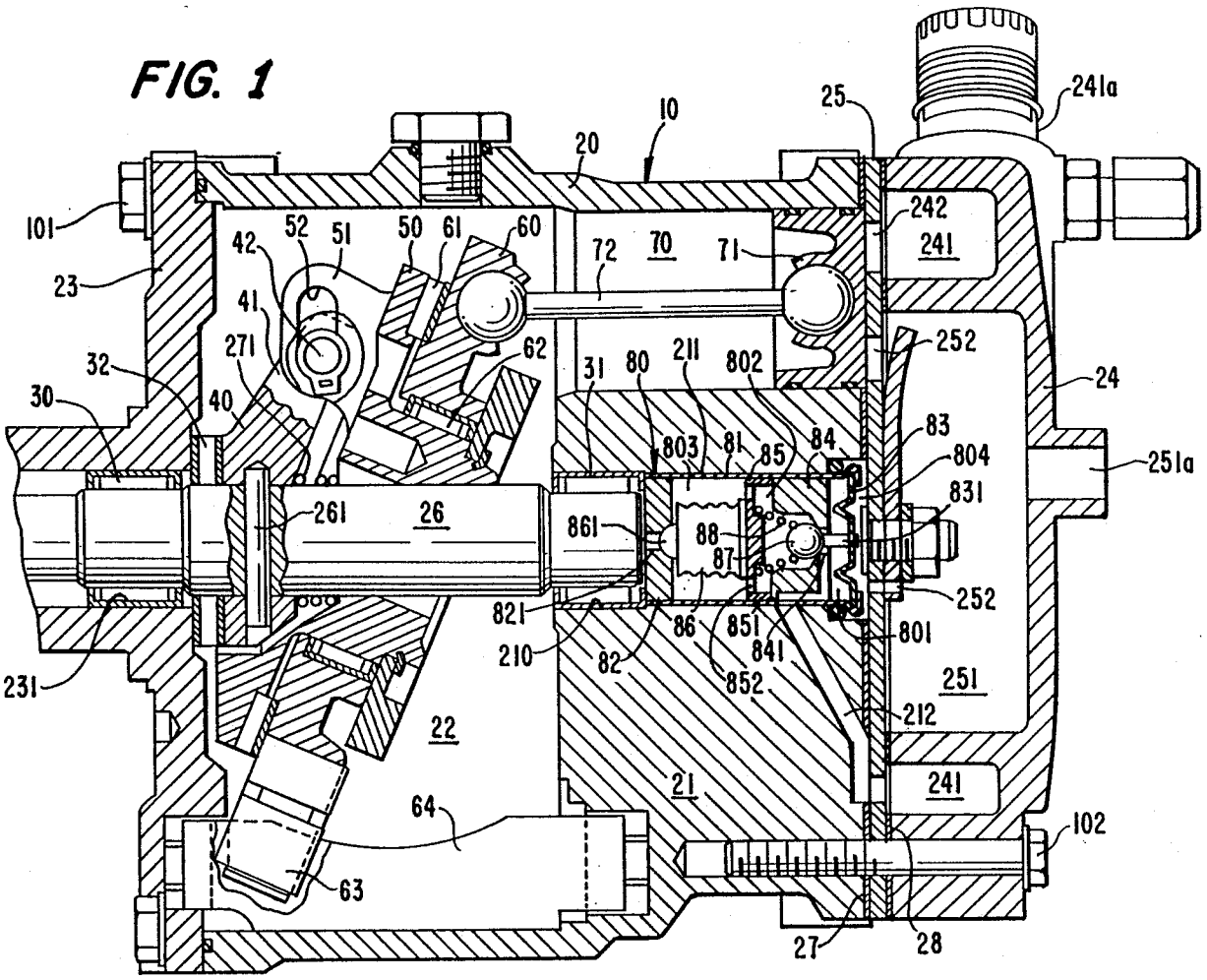
FIG. 1 is a cross-sectional view of the wobble plate type compressor with a variable displacement mechanism in accordance with one embodiment of this invention.

With reference to FIG. 1, wobble plate type refrigerant compressor 10 in accordance with one embodiment of the present invention is shown. Compressor 10 include cylindrical housing assembly 20 including cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward (to the left in FIG. 1) of crank chamber 22 by a plurality of bolts 101. Rear end plate 24 is mounted on cylinder block 21 at its opposite end by a plurality of bolts 102. Valve plate 25 is located between rear end plate 24 and cylinder block 21. Opening 231 is centrally formed in front end plate 23 for supporting drive shaft 26 therethrough by bearing 30 disposed within. The inner end portion of drive shaft 26 is rotatably supported by bearing 31 within central bore 210 of cylinder block 21. Central bore 210 includes cylindrical chamber 211 rearward (to the right) of the end of drive shaft 26, and valve control mechanism 80 is contained therein as discussed below.

Cam rotor 40 is fixed on drive shaft 26 by pin member 261 and rotates therewith. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having slot 52. Cam rotor 40 and slant plate 50 are connected by pin member 42 which is inserted in slot 52 to create a hinge. Pin member 42 is slidable within slot 52 to allow adjustment of the angular position of slant plate 50 with respect to the longitudinal axis of drive shaft 26. Coil spring 271 is disposed on the outer peripheral surface of drive shaft 26 at a location between cam rotor 40 and slant plate 50. Coil spring 271 urges slant plate 50 towards cylinder block 21 so that its slant angle with respect to a plane perpendicular to the longitudinal axis of drive shaft 26 is at its minimum.

Wobble plate 60 is nutatably mounted on slant plate 50 through bearings 61 and 62. Fork shaped slider 63 is attached to the outer peripheral end of wobble plate 60 and is slidably mounted on guide bar 64 held between front end plate 23 and cylinder block 21. Fork shaped slider 63 prevents rotation of wobble plate 60 and wobble plate 60 nutates along bar 64 when cam rotor 40 rotates. Cylinder block 21 includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 21. Valve plate 25 is located between cylinder block 21 and rear end plate 24 and includes a plurality of suction ports 242 linking suction chamber 241 with respective cylinders 70. Valve plate 25 also includes a plurality of discharge ports 252 linking discharge chamber 251 with respective cylinders 70. Suction ports 242 and discharge ports 252 are provided with suitable reed valves on both end surfaces of valve plate 25.

Suction chamber 241 is connected to an evaporator of the external cooling circuit by an inlet port (both not shown). Discharge chamber 251 is provided with outlet port 251*a* connected to a condenser of the cooling circuit (not shown). Gaskets 27 and 28 are located between cylinder block 21 and the inner surface of valve plate 25, and the outer surface of valve plate 25 and rear end plate 24 respectively, to seal the mating surfaces of cylinder block 21, valve plate 25 and rear end plate 24.

Valve control mechanism 80 is disposed within cylindrical chamber 211 and includes cylindrical casing 81, annular end plate 82 with hole 821 therethrough at its forward end (leftmost), and diaphragm 83 at its rearward (rightmost) end. Valve seat 84 is provided with hole 841 therethrough and is fixed on the inner surface of cylindrical casing 81 at a location forward of diaphragm 83. Pedestal 85 includes shank portion 851 fixed on the forward surface of valve seat 84. The interior of valve control mechanism 80 is divided into three chambers; first chamber 801 defined between diaphragm 83 and valve seat 84, second chamber 802 defined between valve seat 84 and pedestal 85 and third chamber 803 defined between pedestal 85 and annular end plate 82. Second chamber 802 is linked with third chamber 803 via holes 852 formed through pedestal 85.

Bellows 86 is located in third chamber 803 and is fixed at one end on the forward surface of pedestal 85. Valve element 861 is provided at the other end of bellows 86. The interior of bellows 86 is maintained at a vacuum. Valve element 861 fits within hole 821 of annular end plate 82 and opens or closes the hole in accordance with the contraction or expansion of bellows 86. Bellows 86, valve element 861 and annular end plate 82 form a first valve control means responsive to suction chamber pressure. Pin 831 is fixed at one end on the forward surface of diaphragm 83 and extends within first chamber 801. The other end of pin 831 extends partially into hole 841 of valve seat 84. Ball 87 is supported by coil spring 88 within second chamber 802 to close hole 841 of valve seat 84. Pin 831 contacts ball 87 to urge it forward in the axial direction to open hole 841 in accordance with the operation of diaphragm 83 as will be discussed below. Pin 831, diaphragm 83, valve seat 84, and ball 87 form a second valve control means controlling the link of the first valve control means with suction chamber 241.

Passage 212 is formed within cylinder block 21 and links first chamber 801 with suction chamber 241 via holes in valve plate 25 and gaskets 27 and 28. Communication hole 252 is formed through valve plate 25, gaskets 27 and 28 and links discharge chamber 251 with fourth chamber 804. Fourh chamber 804 is defined between the outer end (rear) surface of diaphragm 83 and the inner end surface of valve plate 25.

The operation of the compressor is as follows:

When rotational motion of an engine (not shown) is transmitted to drive shaft 26, cam rotor 40 fixed to drive shaft 26 is rotated therewith. Rotational motion of the rotor 40 is converted into nutational motion of wobble plate 60 through slant plate 50. Rotational motion of wobble 60 is prevented by slider 63 slidably disposed on the upper end surface of guide bar 64. Nutational motion of wobble plate 60 is converted into reciprocating motion of pistons 71 via connecting rods 72, and pistons 71 reciprocates within respective cylinders 70. Accordingly, refrigerant gas is drawn into cylinders 70 from suction chamber 241 through suction ports 242, is compressed in cylinders 70, and discharged into discharge chamber 251 through discharge ports 252. The compressed gas in discharge chamber 251 flows into the refrigerant circuit through outlet port 251*a*.

When the air conditioning system is not operating, the pressure in suction chamber 241 is almost equal to the pressure in discharge chamber 251 and therefore, the pressure in first chamber 801 linked to suction chamber 241 through conduit 212 is almost equal to the pressure in fourth chamber 804 linked to discharge chamber 251 via hole 252. Since the pressure is nearly equal on both sides of diaphragm 83, it does not move in any direction and ball 87 is urged into a position closing hole 841 of valve seat 84 due to the recoil strength of coil spring 88. When the air conditioning system begins to operate, drive shaft 26 begins to rotate. At this time, the angle of wobble plate 60 with respect a plane perpendicular to the drive axis of drive shaft 26 is largest due to the action of coil spring 271 urging slant plate 50 and thus wobble plate 60 towards the right as shown in the figure.

As the compressor operates, refrigerant gas is compressed and flows into discharge chamber 251 as discusse above. Accordingly, the pressure in discharge chamber 251 gradually increases, creating a difference in pressure between suction chamber 241 and discharge chamber 251. Additionally, the pressure in crank chamber 22 increases as well due to blow-by gas flowing by pistons 71, causing the angle of the slant plate to decrease. Since ball 87 prevents flow of refrigerant gas through hole 841 of valve seat 84, bellows 86 is isolated from the suction chamber pressure, hole 861 remains closed and the pressure in crank chamber 22 is maintained at a level allowing the pressure in suction chamber 241 to remain close to the pressure in discharge chamber 251, and allowing the angle of slant plate 50 and wobble plate 60 to remain smallest.

When the pressure difference between suction and discharge chambers 241 and 251 does increase to a value greater than a predetermined value P, diaphragm 83 is distorted towards the left in the figure, and pin 831 contacts ball 87, urging it to the left against the recoil strength of coil spring 88. Ball 87 is upseated from valve seat 84 and hole 841 therethrough is gradually opened. The refrigerant gas in suction chamber 241 flows into their chamber 803 through passageway 212, first chamber 801, hole 841, second chamber 802 and holes 852 in pedestal 85 to equalize the pressure in suction chamber 241 and third chamber 803.

After hole 841 is opened, when the pressure in suction chamber 241 becomes greater than the extending force of bellow 86, bellows 86 contracts moving valve element 861 out of hole 821 of annular end plate 82. Hole 821 is opened, and accordingly, blow-by gas flows from crank chamber 22 to suction chamber 241 via gaps in radial bearing 31 and the various chambers, holes and passageways discussed above. Therefore, the pressure in crank chamber 22 is reduced and the angle of slant plate 50 and wobble plate 60 with respect to a plane perpendicular to the longitudinal axis of drive shaft 26 is increased, increasing the stroke length of the pistons as well. Therefore, the compression capacity of compressor 10 increases. Thereafter, the capacity is controlled directly in response to the pressure in suction chamber 241. Furthermore, coil spring 27 may be eliminated altogether since the angle of wobble plate 60 is at its lowest immediately after the compressor begins to operate due to the increased pressure in the crank chamber. The provision of the second valve control means prevents the operation of the bellows which links the suction and crank chambers until after the discharge chamber pressure reaches a certain level. Since this level is not reached until some time after the compressor begins to operate, torque shock and clutch cycling is prevented.

Figure 2:
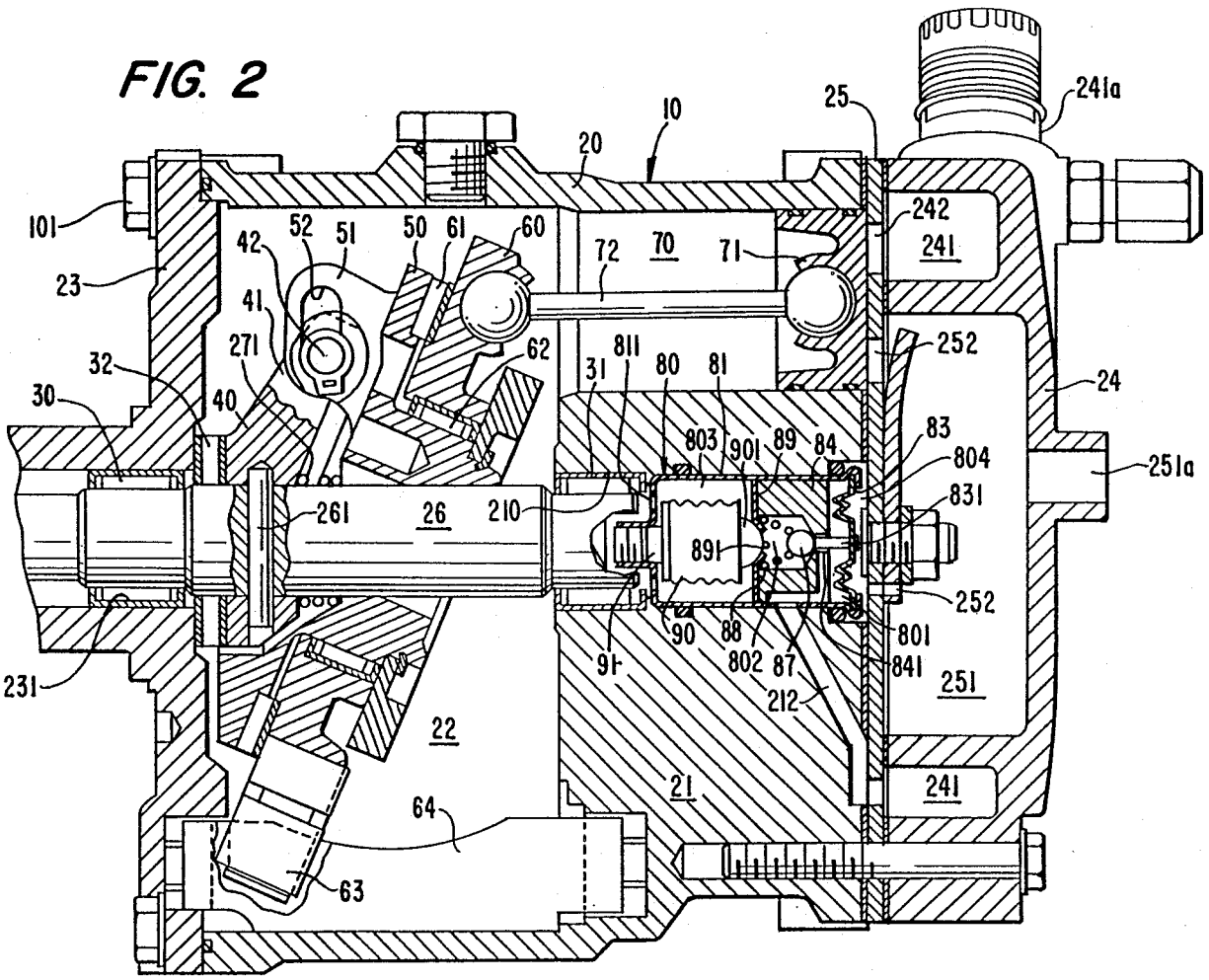
FIG. 2 is a cross-sectional view of the wobble plate type compressor with a variable displacement mechanism in accordance with another embodiment of this invention.

FIG. 2 shows a second embodiment of the present invention in which the same numerals are used to denote the same elements shown in FIG. 1. In the seconnd embodiment, valve control mechanism 80 includes annular end plate 89 with hole 891 therethrough fixed on the forward end of valve seat 84 and defining second chamber 802 therebetween. Pedestal 91 is attached to a forward end of cylindrical casing 81, and bellows 90 is attached thereto. At its other end, bellows 90 is provided with valve element 901. Valve element 901 opens and closes hole 891 of annular end plate 89 in accordance with the contraction or expansion of bellows 90. Holes 811 are formed through a forward end of cylindrical casing 81 to link crank chamber 22 to third chamber 803 formed between pedestal 91 and plate 89.

As described above, when the air conditioning system is not operating, ball 87 is supported within valve seat 84 due to the recoil strength of spring 88 to close hole 841. When the air conditioning system operates and compressor 10 is driven, compressed gas in cylinder 70 leaks into crank chamber 22 via a gap between the inner surfaces of cylinders 70 and the outer peripheral surfaces of pistons 71, increasing the pressure in crank chamber 22. Simultaneously, the pressure difference between discharge chamber 251 and suction chamber 241 increases as well. When the pressure difference between the suction and discharge chambers increases to a value greater than a predetermined value P, diagragm 83 is distorted to the left and pin 831 displaces ball 87 to open hole 841. Additionally, the compressed gas in crank chamber 22 flows into third chamber 803 through gaps between the inner surface of radial bearing 31 and the outer surface of drive shaft 26 and through holes 811. Therefore, the pressure in third chamber 803 is maintained equal to the pressure in crank chamber 22. When the pressure in crank chamber 22 increases to a level greater than the extending force of bellows 90, bellows 90 contracts moving valve portion 901 out of hole 891. Therefore, crank chamber 22 is linked with suction chamber 241 through the various chambers and passages, reducing the pressure in crank chamber 22. The angle of slant plate 50 and wobble plate 60 increases, increasing the compression ratio of compressor 10. However, even though the operation of bellows 90 is dependent on the crank chamber pressure in this embodiment, the link between the suction and crank chambers still does not occur until after the operation of diaphragm 83 and pin 831, that is, when the discharge pressure exceeds the suction pressure by a predetermined amount.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a refrigerant compressor including a compressor housing having a cylinder block provided with a plurality of cylinders, a front end plate disposed on one end of said cylinder block an enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle, and linking means for operationally linking said slant plate to said pistons such that rotation of said drive shaft, rotor and slant plate reciprocates said pistons said cylinders, said slant angle changing in response to a change in pressure in said crank chamber to change the capacity of said compressor, said front end plate rotatably supporting said drive shaft in a hole therethrough, a rear end plate disposed on the opposite end of said cylinder block from said front end plate and defining a suction chamber and a discharge chamber therein, a passageway linking said suction chamber with said crank chamber and a control mechanism controlling the opening and closing of said passageway, the improvement comprising:

said control mechanism including a first valve control means disposed in said passageway near one end for controlling the link of said passageway to said crank chamber in response to the pressure in said passageway, and a second valve control means disposed near an opposite end of said passageway for controlling the link of said passageway to said suction chamber in response to a pressure difference between said discharge chamber and said suction chamber, said second valve control means linking said passageway with said suction chamber when said pressure difference exceeds a predetermined value to allow said first valve control means to act in response to said suction pressure.

2. The refrigerant compressor recited in claim 1, said compressor having an urging means urging said slant plate in an axial direction causing the angle of said slant plate with respect to the plane perpendicular to the longitudinal axis of the drive shaft to be at a maximum angle.

3. The compressor recited in claim 1, said linking means comprising a wobble plate disposed about said drive shaft, said inclined surface of said slant plate in close proximity to said wobble plate, said wobble plate linked to said pistons, rotational motion of said slant plate converted to nutational motion of said wobble plate to reciprocate said pistons in said cylinders.

4. The refrigerant compressor as recited in claim 1, further including said control mechanism comprising a cylindrical casing located in said passageway, said second valve control means comprising a diaphragm at one end of said cylindrical casing with a pin extending therefrom into said cylindrical casing, a valve seat with a hole therethrough located forward of said diaphragm, said pin extending approximately to said hole of said valve seat, a pedestal extending forward from said valve seat, a ball extending from a coil spring attached to said pedestal, said spring urging said ball into said hole in said valve seat, said diaphragm moving said pin to displace said ball from said hole to open said hole when the discharge chamber pressure exceeds the suction chamber pressure by the predetermined value.

5. The refrigerant compressor recited in claim 4, said first value control means further comprising an annular end plate with a hole therethrough located at a forward end of said cylindrical casing opposite said diaphragm, a bellows extending from said pedestal at one end and having a valve element at its other end located adjacent said hole through said annular end plate, said bellows contracting in response to the suction pressure when said pin displaces said ball, linking said crank chamber with said suction chamber.

6. In a refrigerant compressor including a compressor housing having a cylinder block provided with a plurality of cylinders, a front end plate disposed on one end of said cylinder block and enclosing a crank within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle, and linking means for operationally linking said slant plate to said pistons such that rotation of said drive shaft, rotor and slant plate reciprocates said pistons in said cylinders, said slant angle changing in response to a change in pressure in said crank chamber to change the capacity of said compressor, said front end plate rotatably supporting said drive shaft in a hole therethrough, a rear end plate disposed on the opposite end of said cylinder block from said front end plate and defining a suction chamber and a discharge chamber therein, a passageway linking said suction chamber with said crank chamber and a control mechanism controlling the opening and closing of said passageway, the improvement comprising;

said control mechanism including a first valve control means disposed in one side of said passageway for controlling the link of said crank chamber to said suction chamber through said passageway in response to the pressure in said crank chamber, and a second valve control means disposed in an opposite side of said passageway for controlling the link of said crank chamber to said suction chamber through said passageway in response to a pressure difference between said discharge chamber and said suction chamber, said second valve control means not allowing said crank chamber to be linked to said suction chamber through said passageways unless said pressure difference exceeds a predetermined value.

7. The refrigerant compressor recited in claim 6 further comprising an urging means urging said slant plate in an axial direction causing the angle of said slant plate with respect to a plane perpendicular to the longitudinal axis of said drive shaft to be at a maximum angle.

8. The compressor recited in claim 6, said linking means comprising a wobble plate disposed about said drive shaft, said inclined surface of said slant plate in close proximity to said wobble plate, said wobble plate linked to said pistons, rotational motion of said slant plate converted to nutational motion of said wobble plate to reciprocate said pistons in said cylinders.

9. The refrigerant compressor recited in claim 6, said control mechanism further comprising a cylindrical casing located in said passageway, said crank and suction chambers linked through the interior of said cylindrical casing, said second valve control means comprising a diaphragm at one end of said cylindrical casing with a pin extending therefrom into said cylindrical casing, a valve seat with a hole therethrough located forward of said diaphragm in said cylindrical casing, said pin extending approximately to said hole of said valve seat, an annular end plate disposed on said valve seat at an end thereof opposite said hole, a ball extending from a coil spring attached to said annular end plate, said spring urging said ball into said hole in said valve seat, said diaphragm moving said pin to displace said ball from said hole to open said hole when the discharge chamber pressure exceeds the suction chamber pressure by the predetermined value.

10. The refrigerant compressor recited in claim 9, said cylindrical casing including a hole formed therethrough at an end opposite the location of said second valve control means, said hole linking said passageway to said crank chamber, said first valve control means comprising a bellows disposed in said passageway and extending from said end of cylindrical casing having said hole therethrough, said bellows having a valve element at its opposite end located adjacent an opening in said annular end plate, said bellows expanding and contracting in response to the crank chamber pressure to open or close said opening in said annular end plate.

* * * * *